US010238182B2

(12) United States Patent
Donovick

(10) Patent No.: US 10,238,182 B2
(45) Date of Patent: Mar. 26, 2019

(54) CUFFLINK DEVICE

(71) Applicant: Stephen Donovick, Houston, TX (US)

(72) Inventor: Stephen Donovick, Houston, TX (US)

( * ) Notice: Subject to any disclaimer, the term of this patent is extended or adjusted under 35 U.S.C. 154(b) by 142 days.

(21) Appl. No.: 15/358,966

(22) Filed: Nov. 22, 2016

(65) Prior Publication Data

US 2017/0143081 A1 May 25, 2017

Related U.S. Application Data

(60) Provisional application No. 62/258,676, filed on Nov. 23, 2015.

(51) Int. Cl.
*A44B 5/00* (2006.01)

(52) U.S. Cl.
CPC ..... *A44B 5/00* (2013.01)

(58) Field of Classification Search
CPC .. A44B 5/00; A44B 5/002; A44B 5/02; Y10T 24/3636
See application file for complete search history.

(56) References Cited

U.S. PATENT DOCUMENTS

| | | | | | |
|---|---|---|---|---|---|
| 273,844 | A * | 3/1883 | Howard | A44B 5/002 | 24/97 |
| 991,819 | A * | 5/1911 | Barney | A44B 5/002 | 24/102 PL |
| 1,593,887 | A * | 7/1926 | Tannenbaum | A44B 5/00 | 24/102 E |
| 1,643,627 | A | 9/1927 | Nissen | | |
| 1,767,436 | A * | 6/1930 | Curtin | A44B 5/00 | 24/102 E |
| 2,161,506 | A * | 6/1939 | De Caracena | A44C 15/00 | 24/1 |
| 2,209,148 | A | 7/1940 | Bezault | | |
| 2,225,889 | A * | 12/1940 | Rubenstein | A44B 5/00 | 24/102 E |
| 2,510,988 | A | 6/1950 | Lewis | | |
| 3,034,188 | A | 5/1962 | Berliner | | |
| 2012/0005862 | A1* | 1/2012 | Severyn | A44B 5/00 | 24/102 SL |
| 2012/0192383 | A1* | 8/2012 | Casubolo | A41F 1/02 | 24/114.7 |

FOREIGN PATENT DOCUMENTS

FR 1224235 A * 6/1960

* cited by examiner

*Primary Examiner* — Victor D Batson
*Assistant Examiner* — Matthew J Sullivan
(74) *Attorney, Agent, or Firm* — Global Intellectual Property Agency, LLC; Daniel Boudwin

(57) ABSTRACT

A cufflink device is provided having a cufflink base, a cufflink cap, and an elastic cord extending therefrom. The cufflink base has an upper end, a lower end, and a midsection. The elastic cord forms a closed loop that extends from the lower end of the cufflink base and is adapted to secure around the midsection of the cufflink base when securing a shirt cuff together. The cufflink cap is supported by the upper end of the cufflink base and can have a variety of ornamental appearances so that the cufflink device can be manufactured in any number of styles. The elastic cord allows the cufflink assembly to expand when a user pulls his or her shirt cuff upwards along his or her arm. The elastic cord may either terminate within the interior of the cufflink base or be secured to the base of the cufflink cap.

12 Claims, 2 Drawing Sheets

CUFFLINK DEVICE

CROSS REFERENCE TO RELATED APPLICATION

This application claims the benefit of U.S. Provisional Application No. 62/258,676 filed on Nov. 23, 2015. The above identified patent application is herein incorporated by reference in its entirety to provide continuity of disclosure.

BACKGROUND OF THE INVENTION

The present invention relates to garment accessories and more particularly to dress shirt cufflinks. More specifically, the present invention that includes an elastic cord to secure the cuff of a shirt to the cufflink and can be manufactured in any number of styles.

This present invention relates to improvements to shirt cufflinks. While most cufflinks include a rigid structure with a rotatable element, the present invention contemplates an elastic member to secure the cuff of a shirt together.

The present invention solves the problem of rolling up shirt sleeves while wearing cufflinks. Generally, when rolling sleeves upwards along a wearer's arm, the cufflink must first be removed. Thereafter, the cuff will not stay in place in the rolled state with the cufflink removed. The cufflink of the present invention provides an elastic cufflink cord that extends from a cufflink base, which can form a closed loop around the cufflink base to secure two ends of a cuff together. This allows a user to either roll up the shirt sleeves without removing the cufflink, or alternatively simply push the shirt cuff upwards along the wearer's arm without removing the cufflink. The elastic cord extends and allows for this optional cuff positioning.

Overall, the present invention provides a new and useful cufflink device. The cufflink device comprises a cufflink base, a cufflink cap, and a cord extending from the cufflink base. The cufflink base secures within the button hole along one end of a shirt cuff, while the cord secures through the button hole along the second end of the shift cuff or alternatively secures around a button along the second end of the shirt cuff. For French cuff shirts, the cord then secures around the cufflink base and the cord provides an elastic connection between the ends of the shirt cuff, allowing the cuff to be slidable along the wearer's arm. For traditional button shirt cuffs, the cord secures around the opposing button and a slider element secures the cord thereto while the cord maintains its connection with the cufflink base in the button hole of the same cuff. The upper end of the cufflink base includes a cufflink cap that can be designed to accommodate different cufflink styles. Therefore, the cufflink provides a useful means of securing shirt cuffs of varying style together and that can be manufactured to have different styles.

SUMMARY OF THE INVENTION

The following summary is intended solely for the benefit of the reader and is not intended to be limiting in any way. The present invention provides a new cufflink device that can be utilized for securing two ends of a wearer's shirt cuffs together.

It is therefore an object of the present invention to provide a new and improved cufflink device that has all of the advantages of the prior art and none of the disadvantages.

It is another object of the present invention to provide a cufflink device having a cufflink base, a cufflink cap, and a cord extending therefrom.

Another object of the present invention is to provide a cufflink device in which the cufflink base has an upper end, a lower end, and a midsection. The upper end is adapted to support the cufflink cap on the cufflink base, while the midsection provides a channel over which the cord may be secured when worn between two ends of a shirt cuff.

Another object of the present invention is to provide a cufflink device in which a central aperture extends through the midsection of the cufflink base and terminates at an upper aperture along the upper end thereof, and at a lower aperture along the lower end thereof. The central aperture extends through the cufflink base and supports the cord therein.

Another object of the present invention is to provide a cufflink device in which the cord forms a closed loop that extends from the midsection of the cufflink base and through the lower aperture of the lower end of the cufflink base. The cord is preferably an elastic material.

Another object of the present invention is to provide a cufflink device in which the midsection of the cufflink base forms a smaller cross section relative to the upper end of the cufflink base and further comprises a channel extending therearound. The channel is disposed about the midsection and between the upper end of the cufflink base and a lower ledge extending outward from the lower end of the cufflink base. The channel supports the closed loop of the cord when securing the cufflink to a shirt cuff.

Another object of the present invention is to provide a cufflink device in which the cord forms a closed loop with a first end and a second end. In one embodiment, the first end and the second end are affixed to a lower surface of the cufflink cap.

Another object of the present invention is to provide a cufflink device in which the cord forms a closed loop with a first end and a second end. In another embodiment, the first end and the second end are affixed together to form a knot that is supported within the midsection of the cufflink base. The knot is larger than lower aperture of the cufflink base to prevent pull through thereof.

Another object of the present invention is to provide a cufflink device in which the upper end of the cufflink base further comprising a depression and a raised edge around the perimeter of the depression, whereby the depression is adapted to support the cufflink cap therein.

Another object of the present invention is to provide a cufflink device in which the cufflink cap further comprises a lower surface and a tab extending therefrom. The tab is sized to fit within the upper aperture of the central aperture through the cufflink base and secure the cufflink cap to the cufflink base.

Another object of the present invention is to provide a cufflink device in which the cord forms a closed loop and further comprises a slider element therealong.

Another object of the present invention is to provide a cufflink device in which the upper end of the cufflink base further comprises a rounded shape, and whereby the lower ledge of the cufflink base further comprises a rounded shape.

Another object of the present invention is to provide a cufflink device in which the upper end of the cufflink base further comprises a rectangular shape, and whereby the lower ledge of the cufflink base further comprises a rounded shape.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

Figure 3A:
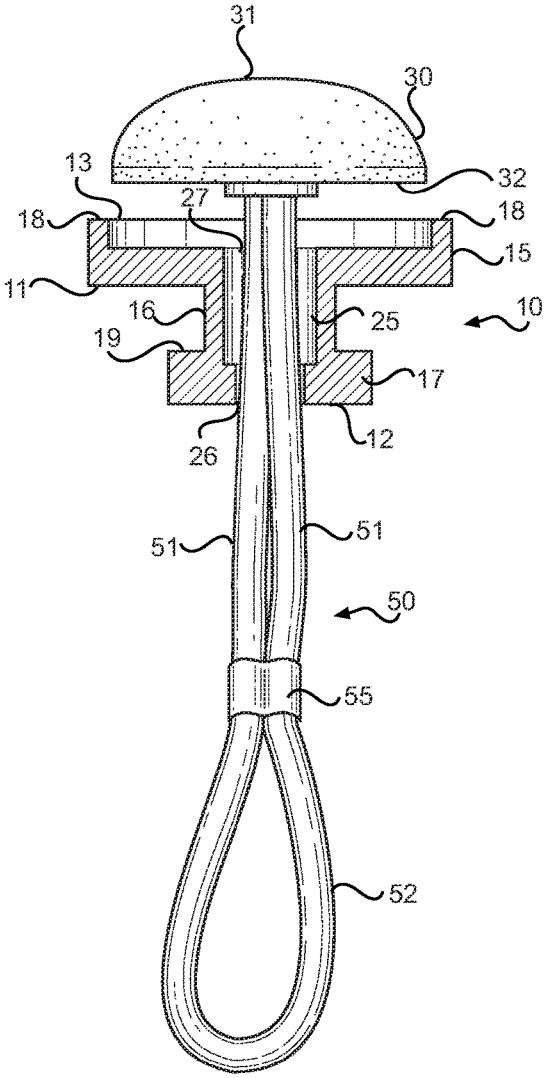

FIG. 3A provides a cross sectional exploded side view of the cufflink device of the present invention.

Figure 3B:
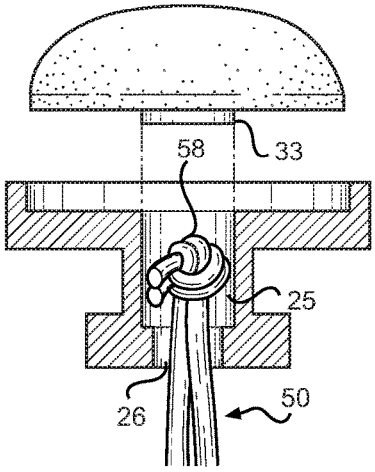

FIG. 3B provides another cross sectional exploded side view of the cufflink device of the present invention.

Figure 4:
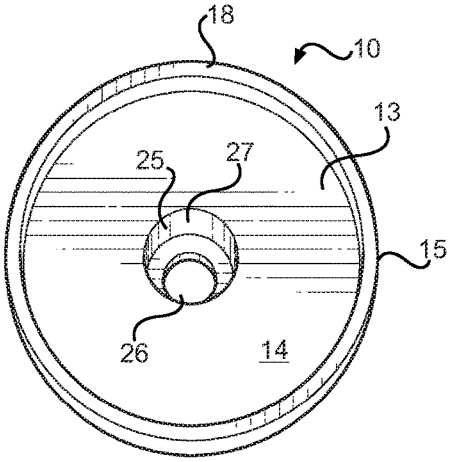

FIG. 4 shows an overhead view of the cufflink base.

DETAILED DESCRIPTION OF THE INVENTION

Reference is made herein to the attached drawings. Like reference numerals are used throughout the drawings to depict like or similar elements of the cufflink device of the present invention. For the purposes of presenting a brief and clear description of the present invention, the preferred embodiment will be discussed as used for securing two ends of a shirt cuff together. The figures are intended for representative purposes only and should not be considered to be limiting in any respect.

Figure 1:
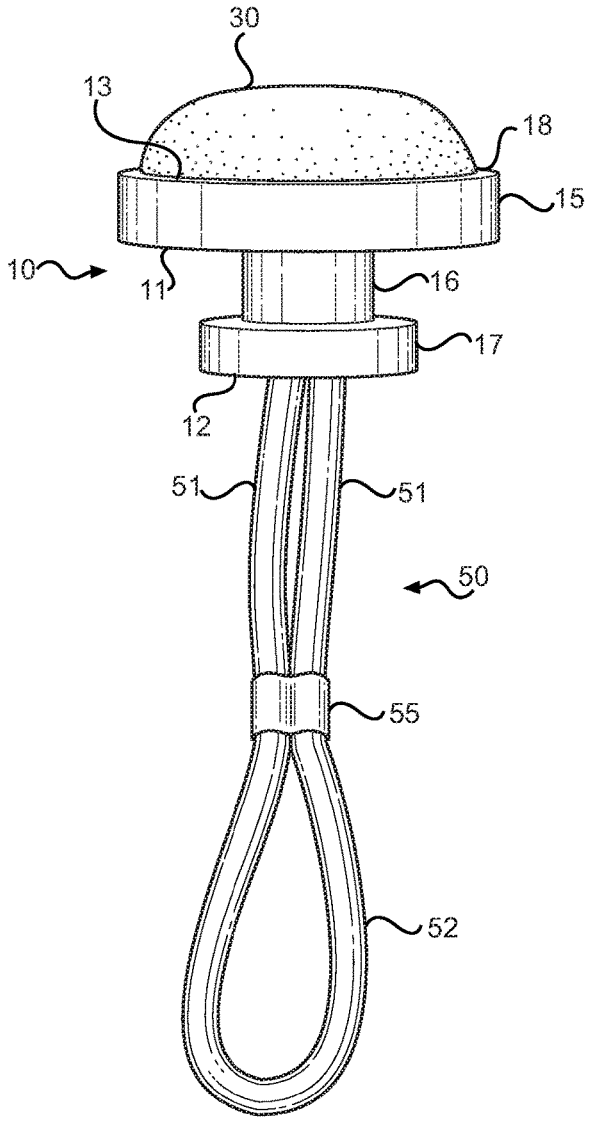
FIG. 1 shows a side view of the cufflink device of the present invention.
Figure 2:
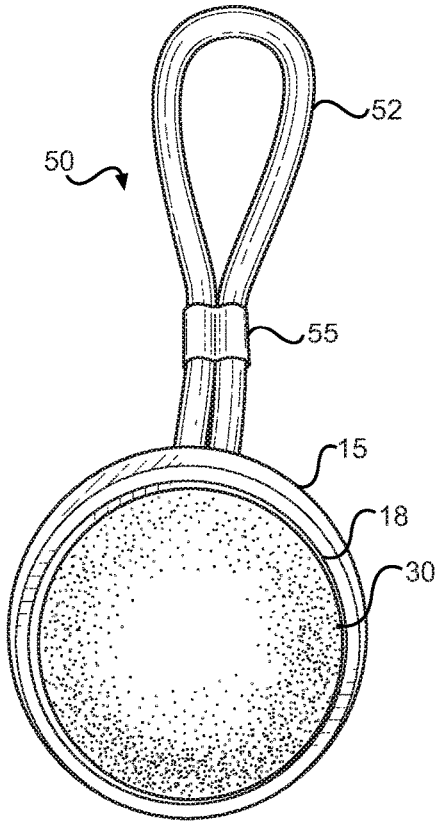
FIG. 2 shows an overhead view of the cufflink device of the present invention.

Referring now to FIGS. 1 and 2, there are shown views of the cufflink device of the present invention. The cufflink device is adapted to secure two ends of a shirt cuff together along the wrist and arm of a wearer. The cufflink secures through one button hole along a first end of the shirt cuff, and thereafter secures through another button hole along the second end of the shirt cuff. The cufflink device is secured to itself to bind the shirt cuff ends together. The preferred configuration of the present invention provides an elastic connection therebetween, allowing the wearer to draw his or her shirt cuff upwards along his or her arm without first removing the cufflink device from the shirt cuff. In addition, the present invention preferably comprises a top cap that can be adorned or designed to suit a specific style as desired by the manufacturer.

In particular, and as shown in FIGS. 1 through 4, the cufflink device comprises a cufflink base 10, a cufflink cap 30, and an elongated cord 50. The cufflink base 10 has an upper end 13, a lower end 12, and a midsection 16. The upper end 13 is adapted to support the cufflink cap 30 and secure the same to the cufflink base 10, while the elongated cord 50 extends from the lower end 12 of the cufflink base 10. The cap 30 comprises a particular style, color, and ornamental design that is adapted to conform to the wearer's preferences. The cap 30 is fixedly secured to the cufflink base 10 via, e.g., epoxy. The cap 30 can include a wide range of decorative elements, including metal, wood, glass, semi-precious stones, and precious stones, thereby allowing the manufacturer to update the look of the cufflink and adapt the same cufflink to different styles. Furthermore, the elongated cord 50 is preferably an elastic material such that the cord can be stretched between two opposing shirt cuffs when donning the cufflink on a shirt.

The cufflink base 10 and the elongated cord 50 function together to secure the ends of a shirt cuff together. The elongated cord 50 extends from the cufflink base 10 and forms a closed loop 52 along the exterior of the cufflink base 10. The closed loop 52 secures through one button hole of a shirt cuff as the cufflink base 10 secures through an opposing button hole on the same shirt cuff. The cord 50 then doubles back and the closed loop 52 secures around the midsection 16 of the cufflink base 10 to secure the ends of the shirt cuff together. The cord 50 therefore has two parallel lengths 51 forming a closed loop 51 that can secure around the midsection 16 of the cufflink base 10 and provide a preferably elastic connection between the shirt cuff button holes when donned.

The cufflink base 10 forms a shape that is adapted to support the closed loop 52 of the cord 50, while also supporting the top cap 30 along the upper end 13 thereof. In particular, the midsection 16 of the cufflink base 10 preferably forms a narrower or smaller cross section relative to the upper end 13 and lower end 12 thereof. In addition, the narrow section of the midsection 16 forms a channel or notch around the exterior of the midsection 16, which is bounded by the upper end 13 of the cufflink base 10 and the lower end 12 of the cufflink base 10. The upper end 13 further comprises a lower surface 11 that extends outward from the midsection 16. Likewise, the lower end 12 further comprises an upper surface 19 that extends around the midsection 16. These surfaces 11, 16 and the outer profile of the midsection 16 form a U-shaped channel around the periphery of the midsection 16 of the cufflink base 10. The closed loop 52 of the cord 52 secures within this channel, as does the periphery of one button hole at the shirt cuff.

Alternatively, the channel may be supported within one button hole of the shirt cuff, and the closed loop 52 of the cord may secure to a button along the opposing end of the shirt cuff if the shirt cuff is not designed to support a cufflink (i.e. the shirt cuff is not a French cuff design). This alternative arrangement and use is also contemplated by the structure of the present invention. This alternative configuration does not require the cord 50 to be doubled back onto itself or looped through an opposing button hole. Rather, the closed loop 52 secures around an existing button while the cufflink base 10 secures within an opposing button hold. In this configuration, a cord slider element 55 is provided to adjust the interior cross section of the closed loop 52. This allows the closed loop 52 to be snugly fit around a button, preventing separation. Using an elastic cord, the cuff can then be moved along the arm of the wearer without first removing the cufflink device. Therefore, the cufflink device is suitable for both standard button cuffs, and French cuff shirts.

As shown in FIGS. 3A and 3B, the cufflink base 10 preferably comprises a T-shaped cross section. The lower end 12 includes extends outwards and forms a larger diameter section 17 than the diameter for the midsection 16, while the upper end 13 forms a larger diameter section 15 further still. That is, the lower end 12 forms a lower ledge 19 and the upper end 13 forms an upper ledge 11, between which is the channel of the midsection 16 for supporting the periphery of a button hole and optionally the closed loop 52 of the cord 50 as well.

In one embodiment, the upper end 13 further comprises a depression 14 along the upper surface thereof. The depression 14 is bounded by a raised edge 18 around the perimeter thereof, whereby the depression 14 extends into the upper end 13 of the cufflink base 10 and is adapted to support the cufflink cap 30 therein. The lower end of the cufflink cap 30 is received within the depression 14 and then adhered to the upper end via, e.g., epoxy, thereby securing the cufflink cap within the upper end 13 thereof. In addition, the lower surface 32 of the cufflink cap 30 may further comprise an outwardly extending tab 33. The tab 33 secures within an upper aperture 27 along the base of the depression 14 to further secure the cap 30 to the cufflink upper end 13.

In a preferred embodiment, the upper aperture 27 along the upper end 13 of the cufflink base 10 connects to a central aperture 25 extending through the cufflink base 10. The central channel 25 forms a tubular opening through the upper end 13, through the midsection 16, and through the lower end 12 of the cufflink base 10 before terminating at a lower aperture 26. As shown in FIG. 4, the central aperture 25 extends through the interior of the cufflink base 10 and provides a clear through-hole therethrough. The central aperture is adapted to support the tab 33 of the cap 30, and additionally a length of the elongated cord 50.

The elongated cord 50 is secured within the cufflink base 10 either by itself or in connection with the cufflink cap 30. As shown in FIG. 3A, the lengths 51 of the cord 50 may connect to the lower end 32 or tab 33 of the cap 30 and extend through the central aperture 25 in the cufflink base 10. The cord 50 extends through the lower aperture 26 to form its closed loop 52 exterior of the cufflink base 10. Alternatively, and as shown in FIG. 3B, the two ends of the cord 50 are fastened together and secured within the cufflink base central aperture 25 without being directly connected to the cap 30. In one such embodiment, the ends of the cord 50 are crimped together and then epoxied in place. In another such embodiment, the ends of the cord 50 are tied together in a knot 58, as shown in FIG. 3B. The ends of the cord 50 may be fastened together by adhesive, additional hardware, or any other such. In this embodiment, the ends of the cord 50 form a structure that is larger than the cross section of the lower opening 26 in order to prevent pull-through thereof. This allows the cord 50 to remain secured within the cufflink base 10 when the closed loop 52 is pulled therefrom.

The cap 30 may comprises a domed upper surface 31 or provide an alternatively shape and ornamental design. In addition, the tab 33 may be sized to secure snugly within the upper aperture 27 in the cufflink base 10. This snug fit may form a friction fit, serving as a secondary form of securement between the cap 30 and the cufflink base 10, beyond the epoxy or other fixed securement between the cap 30 and the upper end 13. In addition, the optional connection to the elongated cord 50 may additional secure the cap 30 to the cufflink base 10, whereby tension on the cord 50 draws the cap 30 against the upper end 13 of the cufflink base 10. Additionally, the cufflink base may comprise a particular shape and ornamental design. In particular, the upper end 13 of the cufflink base 10 and the lower edge 17 thereof may comprise a rounded shape. Alternatively, the upper end 13 and/or the lower ledge 17 of the cufflink base 10 may comprise a rectangular shape. The exact design and size may vary depending on the application and look desired by the user.

Overall, the present invention provides a cufflink device that allows the user to draw his or her shirt cuff up his or her arm without removing the cufflink device. The device may be used with traditional button or French cuff shirts, and the device may be adapted for different outfits by manufacturing the cap with different materials, colors, shapes, designs, or styles. The elongated cord preferably comprises an elastic cord material, such as parachute cord material (paracord) or the like. The cord can be looped around a shirt button or placed through a button hole, while the cufflink base secures within an opposing button hole. The cord secures back around the cufflink base or the slider element draws the closed loop of the cord around the shirt cuff button. Therefore, the device is useful for different shirt cuff styles. In addition, the elasticity of the paracord allows the user to push up a shirt cuff without removing the cufflink.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cufflink device, comprising:

a cufflink base, a cufflink cap, and a cord;

the cufflink base having an upper end, a lower end, and a midsection;

the upper end is adapted to fixedly support the cufflink cap to the cufflink base;

a central aperture extends through the midsection of the cufflink base and terminates at an upper aperture along the upper end of the cufflink base and at a lower aperture along the lower end of the cufflink base;

the cord forming a closed loop that extends from the midsection of the cufflink base and through the lower aperture of the lower end of the cufflink base;

wherein the cord forms a closed loop with a first end and a second end;

whereby the first end and the second end are affixed to a lower surface of the cufflink cap;

whereby the midsection of the cufflink base forms a smaller cross section relative to the upper end of the cufflink base and further comprises a channel extending therearound;

the channel being disposed about the midsection and between the upper end of the cufflink base and a lower ledge extending outward from the lower end of the cufflink base.

2. The cufflink device of claim 1, wherein:

the upper end of the cufflink base further comprising a depression and a raised edge around the perimeter of the depression, whereby the depression is adapted to support the cufflink cap therein.

3. The cufflink device of claim 1, wherein:

the cufflink cap further comprises a lower surface and a tab extending therefrom;

the tab being sized to fit within the upper aperture of the central aperture through the cufflink base and secure the cufflink cap to the cufflink base.

4. The cufflink device of claim 1, wherein:

the cord forms a closed loop and further comprises a slider element therealong.

5. The cufflink device of claim 1, wherein:

the upper end of the cufflink base further comprises a rounded shape; and whereby the lower ledge of the cufflink base further comprises a rounded shape.

6. The cufflink device of claim 1, wherein:

the upper end of the cufflink base further comprises a rectangular shape.

7. A cufflink device, comprising:

a cufflink base, a cufflink cap, and a cord;

the cufflink base having an upper end, a lower end, and a midsection;

the upper end is adapted to fixedly support the cufflink cap to the cufflink base;

a central aperture extends through the midsection of the cufflink base and terminates at an upper aperture along the upper end of the cufflink base and at a lower aperture along the lower end of the cufflink base;

the cord forming a closed loop that extends from the midsection of the cufflink base and through the lower aperture of the lower end of the cufflink base;

wherein the cord forms a closed loop with a first end and a second end;

whereby the first end and the second end are affixed together to form a knot that is supported within the midsection of the cufflink base;

the knot being larger than lower aperture of the cufflink base to prevent pull through thereof;

whereby the midsection of the cufflink base forms a smaller cross section relative to the upper end of the cufflink base and further comprises a channel extending therearound;

the channel being disposed about the midsection and between the upper end of the cufflink base and a lower ledge extending outward from the lower end of the cufflink base.

8. The cufflink device of claim 7, wherein the upper end of the cufflink base further comprises a depression and a raised edge around the perimeter of the depression, whereby the depression is adapted to support the cufflink cap therein.

9. The cufflink device of claim 7, wherein:

the cufflink cap further comprises a lower surface and a tab extending therefrom;

the tab being sized to fit within the upper aperture of the central aperture through the cufflink base and secure the cufflink cap to the cufflink base.

10. The cufflink device of claim 7, wherein the cord forms a closed loop and further comprises a slider element therealong.

11. The cufflink device of claim 7, wherein the upper end of the cufflink base further comprises a rounded shape and the lower ledge of the cufflink base further comprises a rounded shape.

12. The cufflink device of claim 7, wherein the upper end of the cufflink base further comprises a rectangular shape.

* * * * *